US006003283A

United States Patent [19]

Hull

[11] Patent Number: 6,003,283

[45] Date of Patent: Dec. 21, 1999

[54] VENTED FLEXIBLE HONEYCOMB

[75] Inventor: H. Robert Hull, San Leandro, Calif.

[73] Assignee: Hexcel Corporation, Pleasanton, Calif.

[21] Appl. No.: 09/074,263

[22] Filed: May 7, 1998

[51] Int. Cl.[6] ..... E04C 2/32

[52] U.S. Cl. ..... 52/783.18; 52/783.15; 52/783.17

[58] Field of Search ..... 52/783.15, 783.17, 52/783.18

[56] References Cited

U.S. PATENT DOCUMENTS

| | | | |
|---|---|---|---|
| 2,608,500 | 8/1952 | Del Mar et al. | 154/45 |
| 2,644,777 | 7/1953 | Havens | 154/45.9 |
| 3,086,624 | 4/1963 | Wyatt | 189/34 |
| 3,156,041 | 11/1964 | Gault | 29/471.1 |
| 3,226,902 | 1/1966 | Elmendorf | 52/615 |
| 3,227,600 | 1/1966 | Holland | 161/68 |
| 3,342,666 | 9/1967 | Hull | 161/135 |
| 3,552,086 | 1/1971 | Allen | 52/618 |
| 3,753,843 | 8/1973 | Hutchison | 161/43 |
| 4,428,993 | 1/1984 | Kohn et al. | 428/117 |
| 4,849,276 | 7/1989 | Bending et al. | 428/117 |

OTHER PUBLICATIONS

Hexcel Corporation, "Honeycomb TSB 120 Mechanical Properties of Hexcel Honeycomb Materials, A Comprehensive Guide to Standard Hexcel Honeycomb Materials, Configurations, and Mechanical Properties," pp. 1–28, 1992.

*Primary Examiner*—Christopher T. Kent
*Assistant Examiner*—Nkeisha J. Maddox
*Attorney, Agent, or Firm*—David J. Oldenkamp

[57] ABSTRACT

Flexible honeycomb panels are vented by providing vent openings at specific locations within the honeycomb core. The invention is applicable to flexible honeycomb panels which are made from bonded corrugated sheets wherein each of the corrugated sheets has upper and lower node ridges and wherein the lower surfaces of lower node ridges are bonded to the upper surface of lower node ridges located on underlying sheets. The corrugated sheets are stacked so that the adhesive or bond lines between the lower nodes are displaced from each other within the stack. Vent openings are located in the upper node ridges to provide venting of the honeycomb structure. Location of vent openings in the upper node ridges can be controlled to provide selective transport of media through the honeycomb.

20 Claims, 5 Drawing Sheets

VENTED FLEXIBLE HONEYCOMB

BACKGROUND OF THE INVENTION

1. Field of the Invention

The present invention relates generally to honeycomb structures. More particularly, the present invention relates to providing ventilation of honeycomb structures which are flexible.

2. Description of Related Art

Honeycomb structures have found wide use in many settings where high strength and light weight are required. Many honeycomb structures are in the form of panels which are made up of honeycomb that is sandwiched between two side surface sheets. A common honeycomb configuration is the one in which honeycomb walls are interconnected to form hexagonal cells. Hexagonal honeycomb sandwich panels are strong and rigid structures. Panels utilizing hexagonal honeycomb cores have been used extensively in aircraft and spacecraft where relatively planar structural elements are needed which are lightweight and strong.

In many situations, it is desirable to provide honeycomb sandwich panels which have the strength associated with conventional hexagonal honeycomb, but which also are sufficiently flexible to be formed into nonplanar shapes. Exemplary flexible and formable honeycombs are described in U.S. Pat. Nos. 3,227,600 and 3,342,666. These types of flexible honeycombs can be formed into structures having compound curves. Circular structures with relatively tight radii may also be formed. Common types of flexible honeycombs are available from Hexcel Corporation under the trademark FLEX-CORE® and DOUBLE-FLEX™.

Honeycomb structures become closed cellular systems when solid side surface sheets are added to form the final honeycomb panel. These closed systems are made up of a multitude of interconnected closed cells. It is essential in certain circumstances that the cells of the honeycomb panel be vented amongst themselves and also vented to the panel exterior. For example, aircraft and space vehicles are subjected to large changes in air pressure. Honeycomb panels must be vented in order to avoid the build-up of damaging pressures within the honeycomb. In addition, there are certain situations where the honeycomb panel is designed to include discreet passageways or conduits through which various gas or vapors are transported. The selective venting of honeycomb structural panels to form such conduits passing through the panels is especially useful on spacecraft where multipurpose elements are desirable.

Some honeycomb manufacturing processes involve the heating and/or generation of gases during final formation of the honeycomb panel. In these situations, the honeycomb core must also be vented or made "breathable" in order to avoid excessive build-up of pressure within the individual cells.

Conventional honeycomb has been vented in a variety of ways. Venting configurations depend in large part upon the final intended use for the sandwich panel assembly. In those situations where structural strength is a prime consideration, venting configurations typically involve providing one or more small vent holes in each cell wall. Alternatively, when strength could be sacrificed in favor of lower densities and high vent rates, honeycomb cores have been made utilizing perforated materials which provide numerous permeations in the honeycomb through which venting can occur.

There are significant structural differences between conventional non-flexible honeycomb and flexible honeycomb.

In addition, there are significant differences in the processes by which these different types of honeycombs are manufactured. As a result, the venting procedures and configurations which typically have been utilized for the more conventional honeycomb cores are not applicable to flexible honeycomb core such as FLEX-CORE® and DOUBLE-FLEX™. Although perforated material may be utilized to provide venting of flexible honeycomb core material, such perforated materials are not well-suited for those situations where high strength or selective passage of certain media through the honeycomb is desired. Accordingly, there is a present need to provide a simple, effective and economically efficient process for making vented flexible honeycomb sandwich panels.

SUMMARY OF THE INVENTION

In accordance with the present invention, a method is provided for making discreet openings in the substrate media which when assembled results in a vented flexible honeycomb. The vent openings are made during the early stages of production and can be located to provide complete venting of the entire honeycomb panel. The vent holes can also be located at selected locations within the honeycomb core to form localized channels or conduits through which various media, such as gases, can be transported.

In accordance with the present invention, the vent openings are made in the corrugated sheets which are eventually bonded together and then expanded to form the flexible honeycomb. The corrugated sheet comprises two edges extending in a lengthwise direction and two edges extending in a thickness direction. The lengthwise edges and thickness edges form the perimeter of a corrugated sheet having upper and lower surfaces. The corrugated sheet, as is conventional in flexible honeycomb production, includes a plurality of node ridges extending between the lengthwise edges of the corrugated sheet. The node ridges are composed of alternating upper and lower node ridges. As a feature of the present invention, vent openings are located in each of the upper node ridges to provide common venting between all of the honeycomb cell units of the resulting flexible honeycomb core.

In many situations, it is desirable to form multiple honeycomb panels from a single stack of corrugated sheets. In such situations, the initial corrugated sheets are divided by segment lines which define corrugated strips extending in the lengthwise direction between the thickness edges of each corrugated sheet. The resulting stack of corrugated sheets are cut along the segment lines to form multiple honeycombs. In accordance with the present invention, at least one vent opening is located in each of the upper node ridges of each of the corrugated strips. In this way, venting of each honeycomb panel is provided when the stack of corrugated sheets is eventually cut along the segment lines to form multiple honeycombs.

As a further feature of the present invention, the vent openings are made using a saw blade, or other cutting device, which is drawn perpendicularly across the top of the upper node ridges. This sawing procedure provides an especially simple and efficient way to form vent openings. The vent openings are preferably made using a thin (0.001–0.050 inch) saw blade in order to limit any reductions in honeycomb core strength and also limit the amount of debris created during formation of the vent openings. In addition, the use of multiple (i.e., "ganged") saw blades is particularly amenable to efficient and economical large-scale production of vented honeycomb. Further, the relatively thin vent openings made by a narrow saw blade produces an opening having relatively smooth edges which require a reduced amount of processing to remove burs or other surface irregularities.

The above discussed and many other features and attendant advantages of the present invention will become better understood by reference to the following detailed description when taken in conjunction with the accompanying drawings.

DETAILED DESCRIPTION OF THE INVENTION

Figure 1:
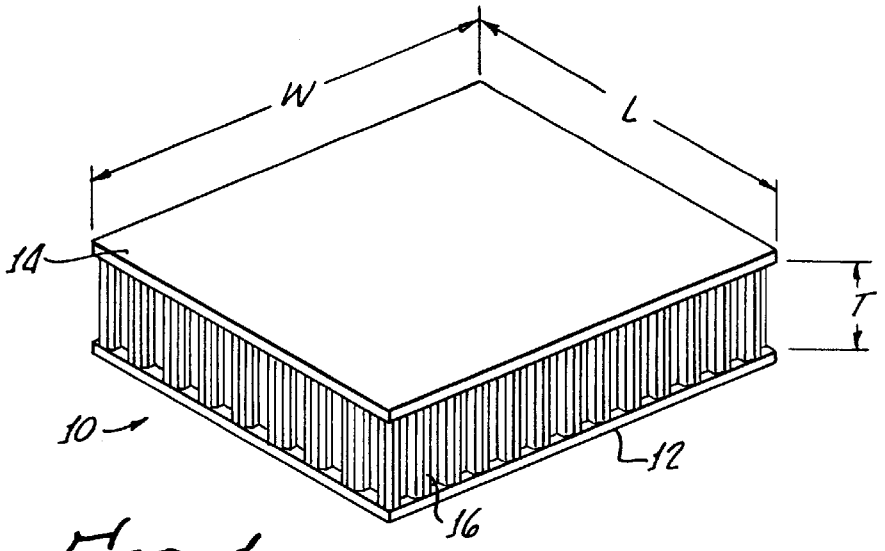
FIG. 1 is a perspective view of a preferred exemplary vented flexible honeycomb panel in accordance with the present invention.
Figure 2:
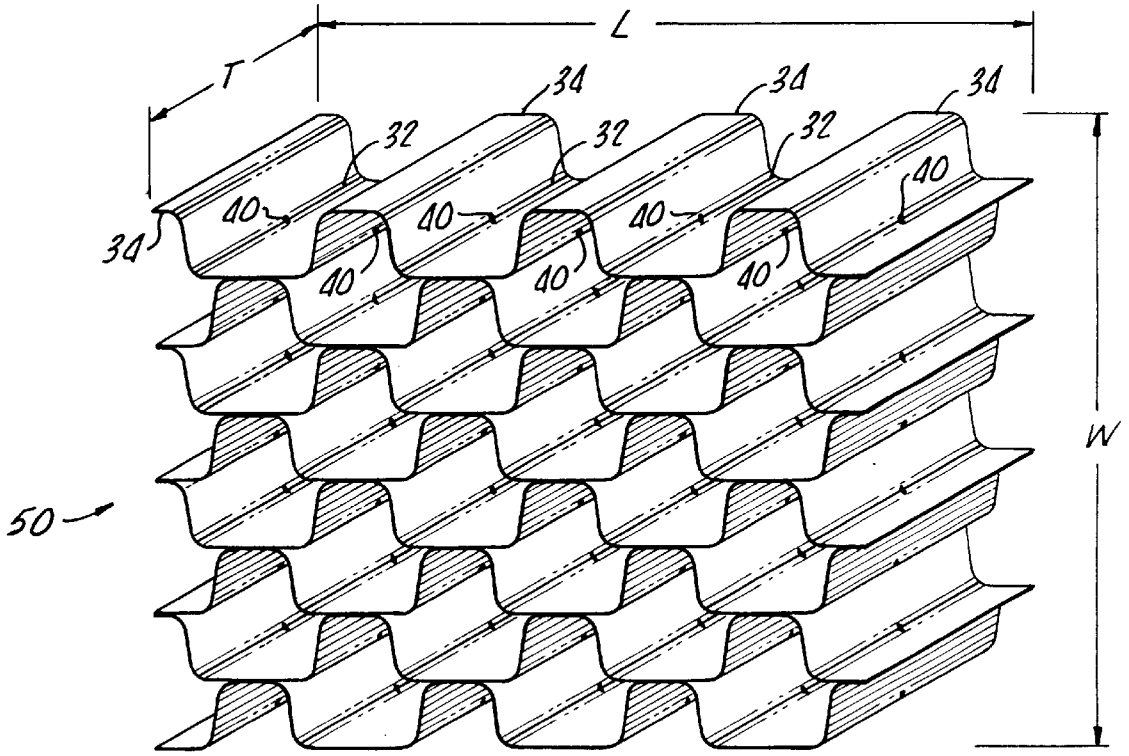
FIG. 2 is a partial perspective view of a section of the preferred exemplary vented flexible honeycomb.
Figure 7:
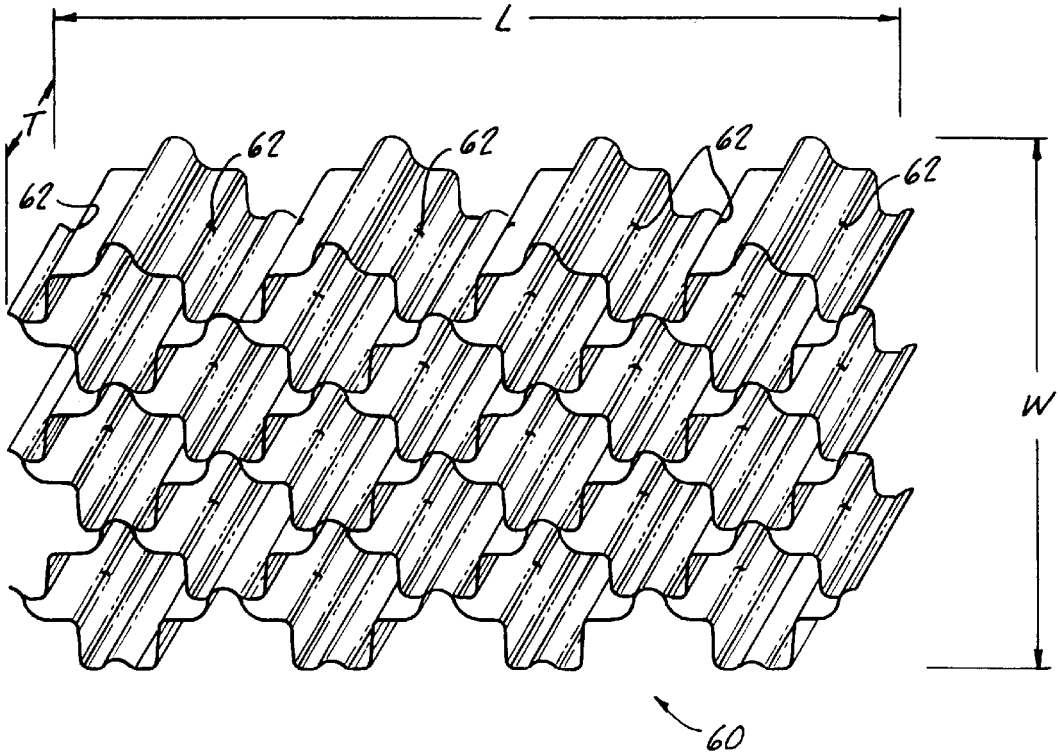
FIG. 7 is a perspective view of a second exemplary vented-flexible honeycomb which is made using the corrugated substrate media shown in FIG. 6.

A vented flexible honeycomb sandwich panel in accordance with the present invention is shown generally at 10 in FIG. 1. The panel 10 includes side surface sheets 12 and 14 between which is sandwiched a vented flexible honeycomb 16. The honeycomb 16 is either the honeycomb shown in FIG. 2 or 7. The honeycomb shown in FIG. 2 is available in an unvented form from Hexcel Corporation (Pleasanton, Calif.) under the tradename FLEX-CORE®. The honeycomb shown in FIG. 7 is also available in an unvented form from Hexcel Corporation under the tradename DOUBLE-FLEX™

The honeycomb sandwich panel 10 has a thickness represented by T, a length represented by L and a width represented by W. The honeycomb 16 can be made from any of the metallic or non-metallic materials which are conventionally used for making honeycomb. Since the honeycomb is designed to be flexible, aluminum and similar type metals are preferred. Flexible non-metallic materials can also be formed to retain the required shape. They are usually formed either with or without the addition of heat or a coating or saturating substance to assist in retaining the formed shape of the substrate. The skins or surface sheets 12 and 14 may also be made from any of the metallic and non-metallic materials conventionally used in making honeycomb panels. The skins 12 and 14 are attached to the honeycomb core using conventional adhesive, thermal bonded welding, soldering or the like.

The vented honeycomb core 16 is made by forming numerous corrugated sheets which are stacked and bonded together and then expanded to form the final honeycomb structure. In some flexible honeycomb, the shape of the corrugated sheets are such that expansion of the stack is not required. A single preferred exemplary corrugated sheet is shown generally at 18 in FIG. 3. The corrugated sheet 18 includes two edges 20 and 22 which extend in a lengthwise direction, as represented by L. The corrugated sheet 18 also includes two edges 24 and 26 which extend in a thickness direction as represented by T. The corrugated sheet 18 includes an upper surface 28 and a lower surface 30. The corrugated sheet 18 also includes upper node ridges 32 and lower node ridges 34. In accordance with the present invention, vent openings 36, 38 and 40 are located along the upper node ridges 32. For exemplary purposes, the corrugated sheet 18 is shown having only a few node ridges. It will be understood that typical corrugated sheets will include a much larger number of upper and lower ridges.

Figure 4:
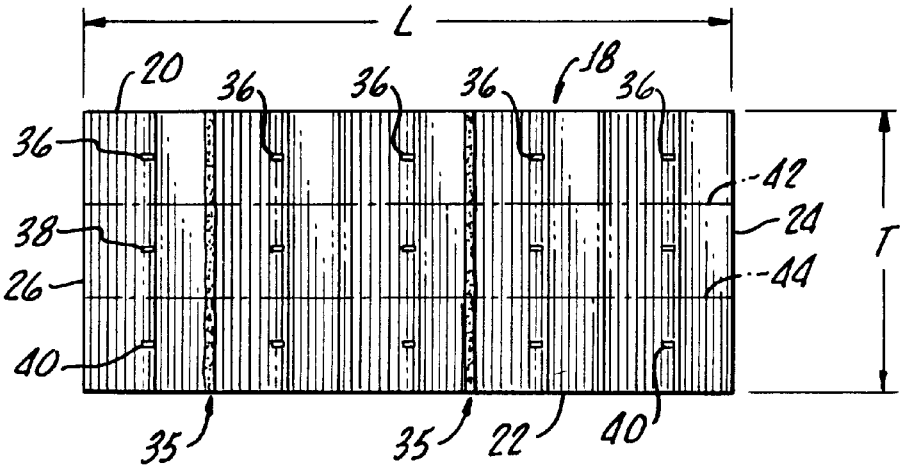
FIG. 4 is a bottom view of the vented corrugated sheet shown in FIG. 3.

As is well known, the corrugated sheets are stacked on top of each other and bonded together to form a block. Usually, the material is sliced after stacking or final formation to form a plurality of slices having the desired thickness. In FIG. 4, phantom segment lines 42 and 44 are included to show the division of the corrugated sheet into multiple strips along which the stacked sheets or expanded honeycomb is sliced to form three honeycombs. In situations where relatively thick panels are desired, there are no segment lines and only one vent per node is required. The stack or expanded honeycomb is not sliced. Typically, slices are cut from the stack of corrugated sheets prior to expansion to form the honeycomb. The slotting devices can be spaced so the resulting slots or vents will appear in each slice cut, or alternately, the required slices can be taken selectively from the block so the slots will appear in the resulting slice.

Figure 8:
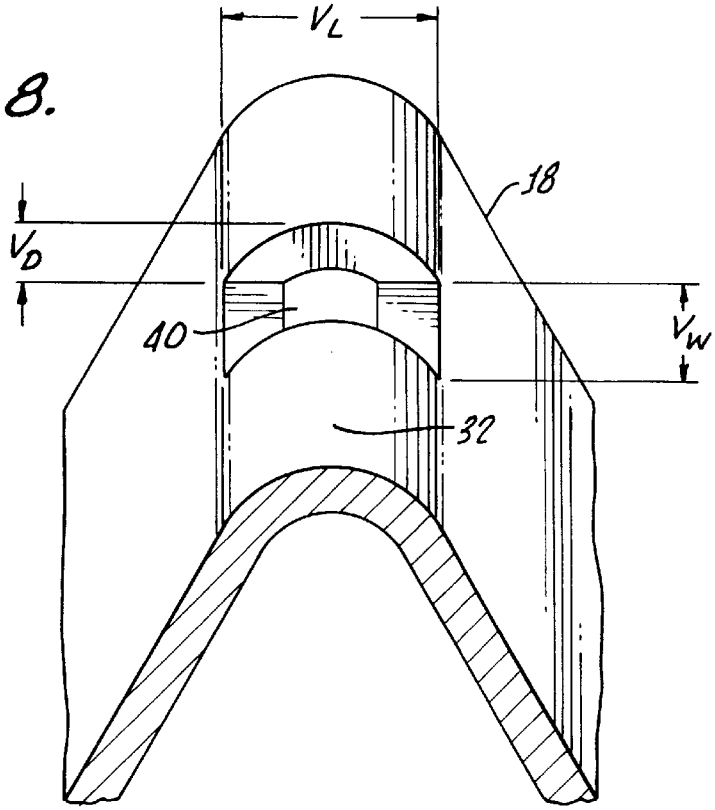
FIG. 8 is a detailed view of a single vent hole in the node of a corrugated sheet in accordance with the present invention wherein the vent hole w s made using a saw blade.

A detailed view of one of the vents 40 in corrugated sheet 18 is shown in FIG. 8. The vent 40 has a width ($V_W$), a length ($V_L$) and depth ($V_D$). Preferably, the width ($V_W$) of the vent should be on the order of 0.001 to 0.050 inch. Widths on the order of 0.004 to 0.020 are particularly preferred since this is the thinnest width of most commercially available saw blades. As can be seen from FIG. 8, the length ($V_L$) of vent opening 40 is related to the depth ($V_D$) of the groove or slot in the node ridge 32. Specifically, $V_L$ increases as $V_D$ is increased. In accordance with the present invention, $V_L$ is determined by the shape of the upper node ridge 32 and $V_D$. Preferably, length ($V_L$) on the order of 0.001 to 0.100 inch are preferred. The size of the vent opening 40 can be increased substantially when relatively thick corrugated sheets are utilized.

It is preferred that the vent holes be kept as small as possible. The least obtrusive size through which light will pass is best as it will have the least degrading effect on the mechanical properties of the end product. In general, the vent openings are sized to provide the desired degree of venting without unduly weakening the honeycomb.

It is preferred that the vent openings are made by sawing across the tops of the upper nodes 32 to form vents where the length of the vent openings 36, 38 and 40 is greater than the width. Although any number of procedures can be used to form the vent openings, it is preferred that the openings be formed by cutting through the tops of nodes 32 with one or more saw blades. Preferably, a series of circular saws are oriented so that multiple rows of vent openings may be cut at the same time by moving the blades across the sheet in a lengthwise direction to cut vent openings in the tops of the ridges 32. If desired, the saw blades may be kept stationary and the sheets moved in order to provide cutting of the nodes. Cutting vent openings with multiple saw blades is especially well-suited for mass production procedures wherein numerous vent openings must be accurately made. Other types of blades or slitters and/or punch apparatus may be utilized, if desired. The shape of the node cut out does not have to be rectangular as shown in FIG. 8. V-shaped grooves and other notch configurations are possible.

Figure 9:
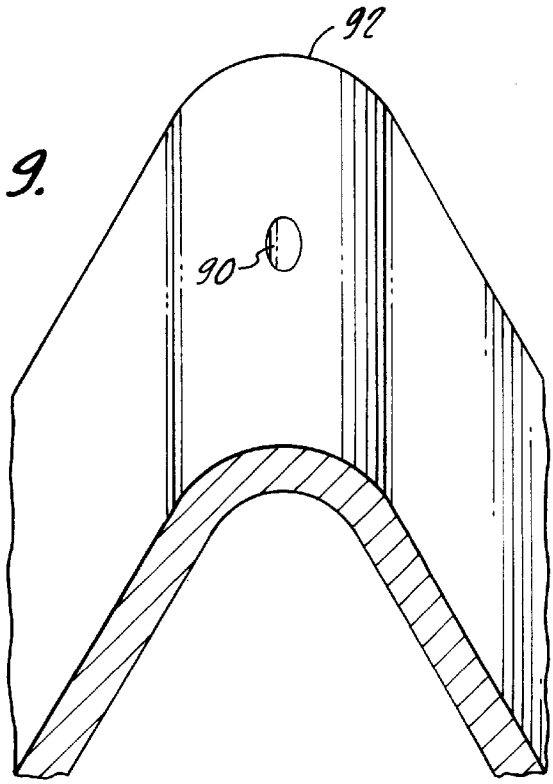
FIG. 9 is a detailed view of an alternate vent hole configuration which can be made using a laser, capacitative discharge apparatus or other permeation device.

As shown in FIG. 9, the vent opening 90 in an exemplary node 92 can be circular or spherical in shape. Vent openings 90 can be made by any variety of processes utilizing a laser, capacitative discharge apparatus or mechanical punch apparatus.

Figure 3:
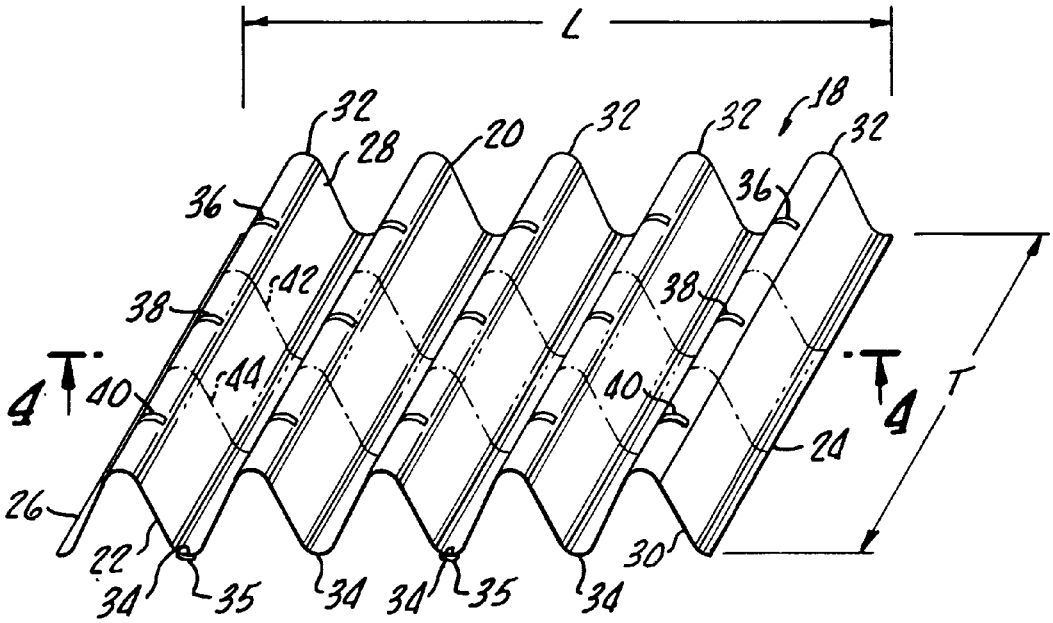
FIG. 3 is a perspective view of a portion of a vented corrugated substrate media or sheet which is used in making the vented flexible honeycomb core shown in FIG. 2.

The corrugated sheet 18 shown in FIGS. 3 and 4 includes vent openings at every upper node ridge 32. When complete venting of the honeycomb core is desired, all of the corrugated sheets used to form the corrugated stack must have a vent opening in each of the upper node ridges. When partial venting is desired, or when media transfer conduits are desired, vent openings in the corrugated sheets are only made in those locations through which media transfer is desired.

Figure 5:
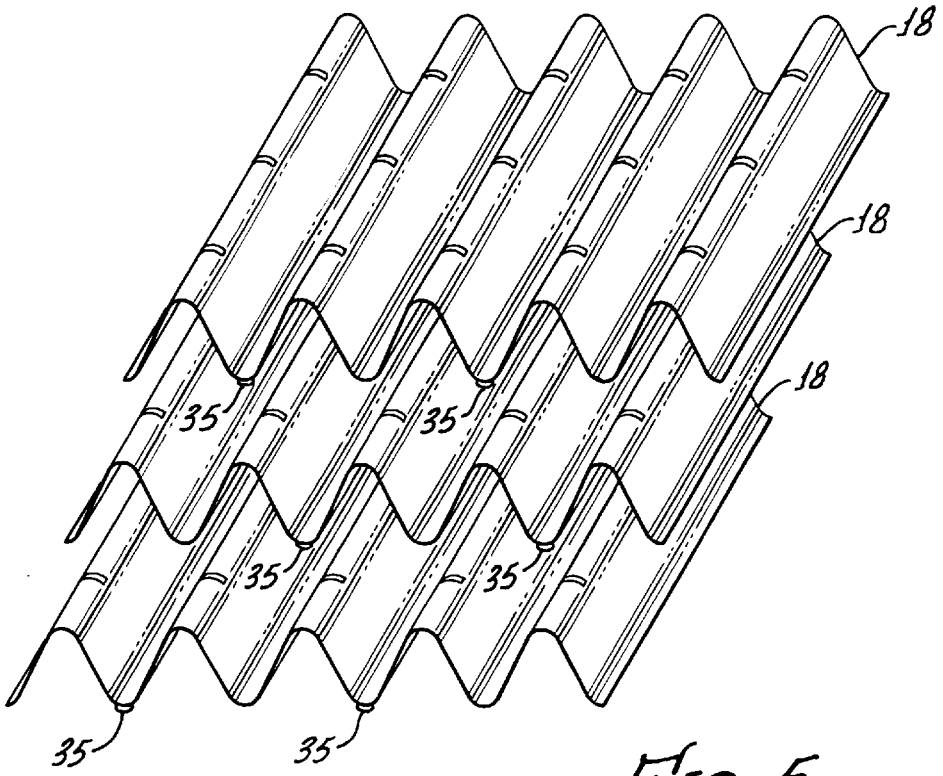
FIG. 5 is a perspective view of multiple corrugated sheets (as shown in FIG. 3) which are being stacked to form the vented-flexible honeycomb shown in FIG. 2.

The next step in forming vented flexible honeycomb, in accordance with the present invention, involves stacking numerous corrugated sheets on top of each other to form a stack of corrugated sheets which are bonded or otherwise attached together. As shown in FIGS. 3 and 4, lines of adhesive 35 are placed along the lower surface of alternating lower node ridges 34. The sheets 18 are stacked such that the lines of adhesive applied to the underside of the lower node ridges are shifted over one ridge between adjacent corrugated sheets (see FIG. 5). Any suitable adhesive may be used to bond the corrugated substrate layers together. Exemplary adhesives include epoxy or phenolic node bond adhesives. Any of the conventional node bonding procedures may be utilized.

In addition to the use of adhesives, the lower surface of alternating lower node ridges may be bonded to the upper surface of underlying lower node ridges by heat bonding or any other suitable process which provides a secure bond between the lower node ridges.

Once the corrugated sheets have been stacked and bonded, the resulting block is expanded to form an expanded flexible honeycomb as shown at 50 in FIG. 2. Reference numerals are included in FIG. 2 only for the top corrugated sheet to avoid cluttering the figure. The reference numerals for the underlying sheets are the same. As can be seen from FIG. 2, the location of vent openings 40 along the node ridge lines throughout the honeycomb provides complete and common venting of all honeycomb cells. Again, if desired vent openings 40 may be limited to specific areas of the honeycomb core where selective transfer of gas or other media through the honeycomb is desired. In such situations, only selected vent openings are made and the remainder of the honeycomb walls are left unvented. The honeycomb 50 shown in FIG. 2 corresponds to only a portion of the honeycomb core which is produced from combining corrugated sheets 18. The honeycomb 50 is the segment of honeycomb which results when the stack of corrugated sheets 18 are sliced along phantom line 44 as shown in FIG. 4.

It should be noted that the honeycomb 50 (as shown in FIG. 2) is made from corrugated sheets 18 which have been flipped over so that the vent openings are in the lower node ridges and the adhesive lines are on the top of the upper node ridges. The honeycomb 50 is shown in this orientation to more clearly depict the location of vent openings 40. The use of the terms upper and lower node ridges is only intended to describe the relative position of the two node ridges in a given sheet in a given orientation. When a corrugated sheet is flipped over, the upper ridges become the lower ridges and the lower ridges become the upper ridges.

The final honeycomb panel 10 as shown in FIG. 1 is made by attaching side skins or sheets to the edges of the expanded honeycomb. The side skins are attached in accordance with conventional honeycomb fabrication procedures utilizing any of the well-known adhesives which are used to attach side panels to honeycomb cores. Although the embodiments described herein require that the block of stacked corrugated sheets be expanded, the present invention is also applicable to process for making flexible honeycomb where the corrugated sheets are initially shaped so that the expansion step is not required.

Figure 6:
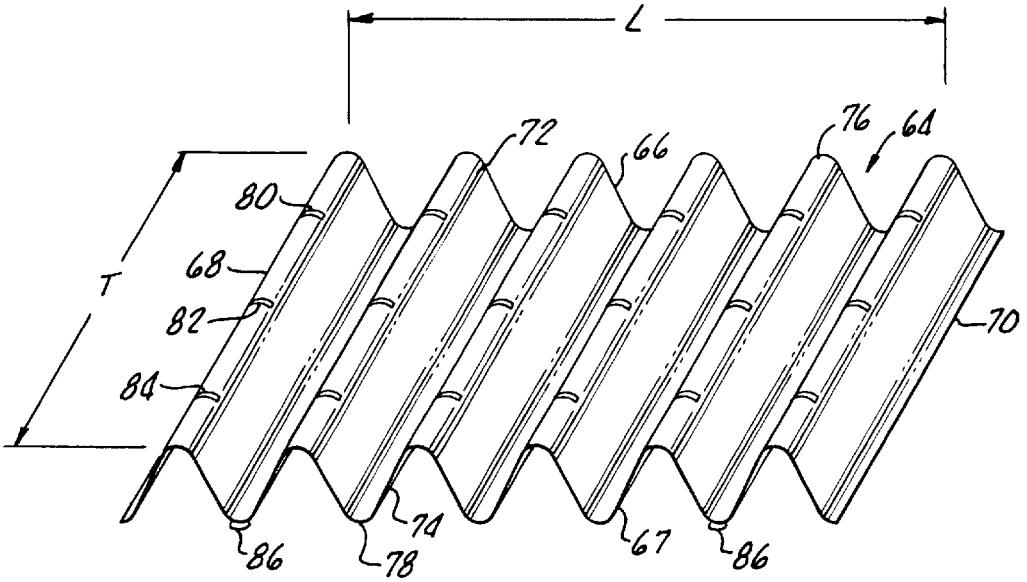
FIG. 6 is a vented corrugated substrate media or sheet which is used to make a second exemplary vented-flexible honeycomb in accordance with the present invention.

A second exemplary vented flexible honeycomb is shown at 60 in FIG. 7. The honeycomb 60 includes vents 62 which provide venting between all of the cells in the honeycomb. The honeycomb 60 is made using the same vented corrugated sheets as used to make honeycomb 50 except that adhesive is applied to the lower surface of every fourth lower node ridge instead of every second lower node ridge. Referring to FIG. 6, an exemplary corrugated sheet is shown generally at 64.

The corrugated sheet 64 includes two edges 66 and 67 which extend in a lengthwise direction, as represented by L. The corrugated sheet 64 also includes two edges 68 and 70 which extend in a thickness direction as represented by T. The corrugated sheet 64 includes an upper surface 72 and a lower surface 74. The corrugated sheet 64 also includes upper node ridges 76 and lower node ridges 78. In accordance with the present invention, vent openings 80, 82 and 84 are located along the upper node ridges 76. For exemplary purposes, the corrugated sheet 64 is shown having only a few node ridges. As was the case with the previously described embodiment, the typical corrugated sheet will include a much larger number of upper and lower ridges.

In order to achieve the honeycomb structure 60, adhesive 86 is only applied to the lower surface of the sheet at every fourth lower node. After the adhesive is applied, the sheets are stacked in the same alternating fashion as described above and shown in FIG. 5. After bonding of the sheets together, the stack is expanded to form the honeycomb shown in FIG. 7. It should be noted that adhesive application patterns are not limited to every other or fourth node. Other adhesive spacings are possible provided that a flexible honeycomb is produced.

The above-described preferred exemplary embodiment of the present invention is well-suited in situations where large amounts of vented honeycomb panels are being manufactured that must be flexible and have high strength. In accordance with the present invention, the number and size of vent openings is kept at a minimum while still maintaining adequate vent and/or gas transport capabilities. The present invention may be used to provide venting of any flexible honeycomb wherein the honeycomb is made by stacking and bonding corrugated sheets to form a stack which is then expanded to form the honeycomb. The basic requirement is that vent openings be located in the node ridges of the corrugated sheet which are opposite from the node ridges to which the adhesive is applied.

Having thus described exemplary embodiments of the present invention, it should be noted by those skilled in the art that the within disclosures are exemplary only and that various other alternatives, adaptations, and modifications may be made within the scope of the present invention. Accordingly, the present invention is not limited to the specific embodiments as illustrated herein, but is only limited by the following claims.

What is claimed is:

1. A corrugated sheet for use in making vented flexible honeycomb panels, said corrugated sheet comprising two edges extending in a lengthwise direction and two edges extending in a thickness direction, said lengthwise edges and said thickness edges defining upper and lower surfaces of said corrugated sheet, said corrugated sheet comprising a plurality of node ridges extending between said lengthwise edges wherein said node ridges comprise alternating upper and lower node ridges, said corrugated sheet further comprising at least one vent opening located in each of said upper node ridges and wherein said corrugated sheet further includes adhesive lines located only on the upper or lower surface of every second lower node ridge.

2. A corrugated sheet for use in making vented flexible honeycomb panels according to claim 1 wherein said sheet comprises multiple corrugated strips extending in said lengthwise direction between said thickness edges and wherein at least one vent opening is located in each of said upper node ridges in each of said strips.

3. A stack of bonded corrugated sheets for use in making vented flexible honeycomb panels wherein a plurality of corrugated sheets according to claim 1 are stacked on top of each other to form a stack of bonded corrugated sheets wherein only the lower node ridges of said corrugated sheets are bonded together and wherein the adhesive lines on adjacent sheets are displaced from each other in said lengthwise direction.

4. A vented flexible honeycomb comprising a stack of bonded corrugated sheets according to claim 3 which has been expanded to form a vented flexible honeycomb having two sides.

5. A vented flexible honeycomb panel comprising a honeycomb according to claim 4 and at least one side sheet attached to at least one side of said honeycomb.

6. A corrugated sheet for use in making vented flexible honeycomb panels, said corrugated sheet comprising two edges extending in a lengthwise direction and two edges extending in a thickness direction, said lengthwise edges and said thickness edges defining upper and lower surfaces of said corrugated sheet, said corrugated sheet comprising a plurality of node ridges extending between said lengthwise edges wherein said node ridges comprise alternating upper and lower node ridges, said corrugated sheet further comprising at least one vent opening located in each of said upper node ridges and wherein said corrugated sheet further includes adhesive lines located only on the upper or lower surface of every fourth lower node ridge.

7. A corrugated sheet for use in making vented flexible honeycomb panels according to claim 6 wherein said sheet comprises multiple corrugated strips extending in said lengthwise direction between said thickness edges and wherein at least one vent opening is located in each of said upper node ridges in each of said strips.

8. A stack of bonded corrugated sheets for use in making vented flexible honeycomb panels wherein a plurality of corrugated sheets according to claim 6 are stacked on top of each other to form a stack of bonded corrugated sheets wherein only the lower node ridges of said corrugated sheets are bonded together and wherein the adhesive lines on adjacent sheets are displaced from each other in said lengthwise direction.

9. A vented flexible honeycomb comprising a stack of bonded corrugated sheets according to claim 8 which has been expanded to form a honeycomb having two sides.

10. A vented flexible honeycomb panel comprising a honeycomb according to claim 9 and at least one side sheet attached to at least one side of said honeycomb.

11. A method for making a corrugated sheet for use in making vented flexible honeycomb panels said method comprising the steps of:

providing a plurality of corrugated sheets, each of said sheets comprising two edges extending in a lengthwise direction and two edges extending in a thickness direction, said lengthwise edges and said thickness edges defining upper and lower surfaces of said corrugated sheet, said corrugated sheet comprising a plurality of node ridges extending between said lengthwise edges wherein said node ridges comprise alternating upper and lower node ridges;

applying lines of adhesive to said corrugated sheet, said lines extending in said thickness direction and wherein said adhesive lines are applied only on the upper or lower surface of every second lower node ridge; and forming at least one vent opening located in each of said upper node ridges in each of said corrugated sheets.

12. A method for making a corrugated sheet for use in making vented flexible honeycomb panels according to claim 11 wherein said sheet comprises multiple corrugated strips extending in said lengthwise direction between said thickness edges and wherein said vent forming step comprises forming at least one vent opening in each of said upper node ridges in each of said strips.

13. A method for making a stack of bonded corrugated sheets for use in making vented flexible honeycomb panels, said method comprising the step of stacking a plurality of corrugated sheets made according to claim 11 on top of each other to form a stack of bonded corrugated sheets wherein only the lower node ridges are bonded together and wherein the adhesive lines on adjacent sheets are displaced from each other in said lengthwise direction.

14. A method for making a vented flexible honeycomb comprising the step of expanding a stack of bonded corrugated sheets made according to claim 13 to form a vented flexible honeycomb having two sides.

15. A method for making a vented flexible honeycomb panel comprising the step of attaching at least one side wall to at least one side of a honeycomb made according to claim 14.

16. A method for making a corrugated sheet for use in making vented flexible honeycomb panels said method comprising the steps of:

providing a plurality of corrugated sheets, each of said sheets comprising two edges extending in a lengthwise direction and two edges extending in a thickness direction, said lengthwise edges and said thickness edges defining upper and lower surfaces of said corrugated sheet, said corrugated sheet comprising a plurality of node ridges extending between said lengthwise edges wherein said node ridges comprise alternating upper and lower node ridges;

applying lines of adhesive to said corrugated sheet, said lines extending in said thickness direction and wherein said adhesive lines are applied only on the upper or lower surface of every fourth lower node ridge; and forming at least one vent opening located in each of said upper node ridges in each of said corrugated sheets.

17. A method for making a corrugated sheet for use in making vented flexible honeycomb panels according to claim 11 wherein said sheet comprises multiple corrugated strips extending in said lengthwise direction between said thickness edges and wherein said vent forming step comprises forming at least one vent opening in each of said upper node ridges in each of said strips.

18. A method for making a stack of bonded corrugated sheets for use in making vented flexible honeycomb panels, said method comprising the step of stacking a plurality of corrugated sheets made according to claim 16 on top of each other to form a stack of bonded corrugated sheets wherein only the lower node ridges are bonded together and wherein the adhesive lines on adjacent sheets are displaced from each other in said lengthwise direction.

19. A method for making a vented flexible honeycomb comprising the step of expanding a stack of bonded corrugated sheets made according to claim 18 to form a vented flexible honeycomb having two sides.

20. A method for making a vented flexible honeycomb panel comprising the step of attaching at least one side wall to at least one side of a honeycomb made according to claim 19.

* * * * *